United States Patent [19]

Pätzold et al.

[11] Patent Number: 4,502,173

[45] Date of Patent: Mar. 5, 1985

[54] FLOOR-SWEEPING MACHINE

[75] Inventors: Dieter Pätzold, Nassau; Alfons Schreiber, Wuppertal; Peter Tiwi, Nassau, all of Fed. Rep. of Germany

[73] Assignee: ITT Industries, Inc., New York, N.Y.

[21] Appl. No.: 422,979

[22] PCT Filed: Jan. 7, 1982

[86] PCT No.: PCT/DE82/00004

§ 371 Date: Sep. 8, 1982

§ 102(e) Date: Sep. 8, 1982

[87] PCT Pub. No.: WO82/02330

PCT Pub. Date: Jul. 22, 1982

[30] Foreign Application Priority Data

Jan. 9, 1981 [DE] Fed. Rep. of Germany ..... 3100497

[51] Int. Cl.[3] ..... A47L 11/33

[52] U.S. Cl. ..... 15/41 R

[58] Field of Search ..... 15/41–46, 15/48, 79 R, 79 A; 248/73; 403/188; 411/182, 908

[56] References Cited

U.S. PATENT DOCUMENTS

| | | | |
|---|---|---|---|
| 3,246,353 | 4/1966 | Farnsworth | 15/41 R |
| 3,444,596 | 5/1969 | Soltysik | 248/73 |
| 3,546,729 | 12/1970 | Miller et al. | 15/41 |
| 3,638,266 | 2/1972 | Fukaba | 15/41 R |
| 4,295,618 | 10/1981 | Morota et al. | 248/73 |
| 4,325,156 | 4/1982 | Rosendall | 15/41 R |

FOREIGN PATENT DOCUMENTS

| | | | |
|---|---|---|---|
| 1957576 | 5/1971 | Fed. Rep. of Germany | 15/41 R |
| 1817906 | 8/1973 | Fed. Rep. of Germany . | |
| 2603582 | 8/1977 | Fed. Rep. of Germany . | |
| 2483563 | 12/1981 | France | 248/73 |

*Primary Examiner*—Edward L. Roberts

*Attorney, Agent, or Firm*—John T. O'Halloran; Peter R. Ruzek; Mary C. Werner

[57] ABSTRACT

Floor-sweeping machine consisting of a housing with a revolving brush mounted rotatably therein and having pinions which are provided at its two ends and which are themselves each connected operatively by engagement to a pair of running drive wheels, the two running drive wheels belonging to a particular pinion being mounted rotatably in a wheel case and the wheel cases being mounted in appropriate housing receptacles so as to be vertically displaceable for adjusting the height of the revolving brush mounted fixedly in the housing, wherein, for a permanent adjustment of the height of the revolving brush without impairing the drive of the revolving brush by the running wheels, each wheel case (26) is retained by means of a wheel-case holder (38) to swing on one leg (44) of a U-shaped adjusting shackle (45), and the U-shaped adjusting shackle (45) is mounted pivotably in appropriate bearings (55) of the housing (11) by means of angled portions (54), shaped on the free ends of the legs (44), and an adjustable wedge face (53) pivoting the U-shaped adjusting shackle (45) downwards against the effect of a force accumulator (67) engages on the crown part (51).

13 Claims, 9 Drawing Figures

Figure 1:
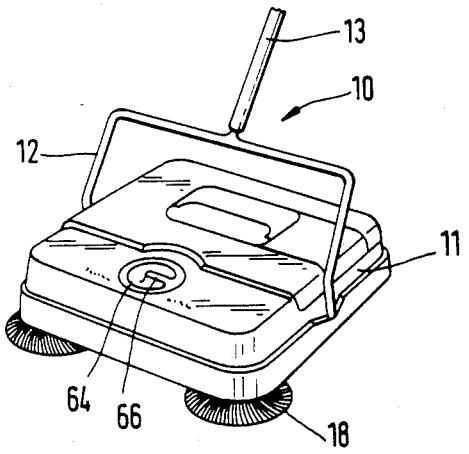

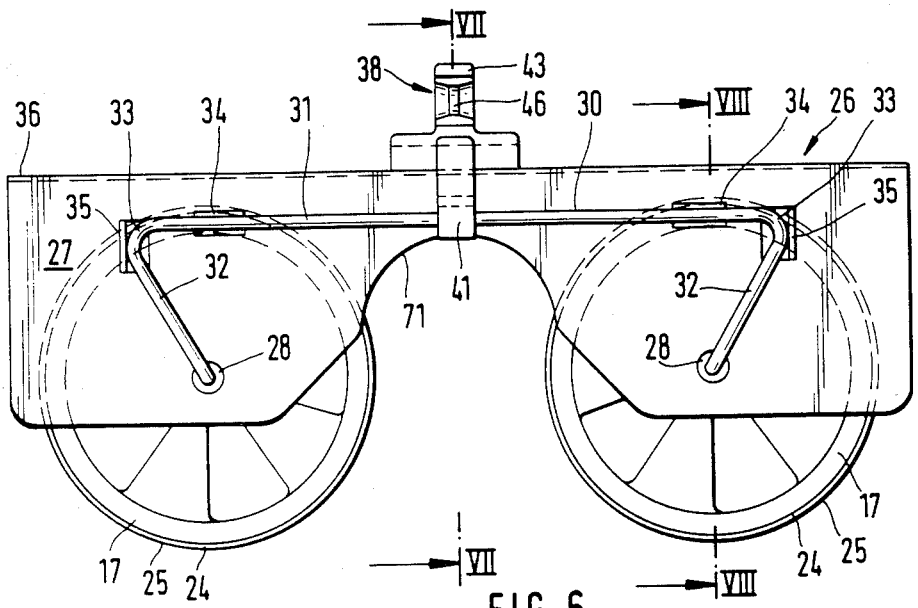
FIG. 6
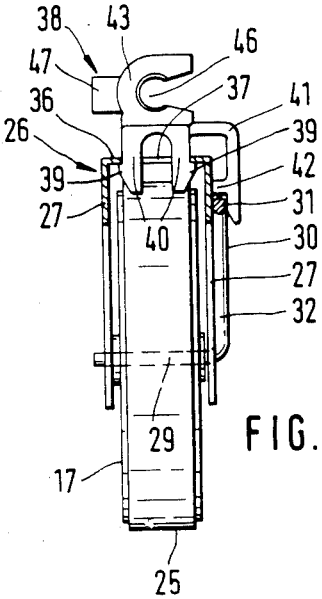
FIG. 7
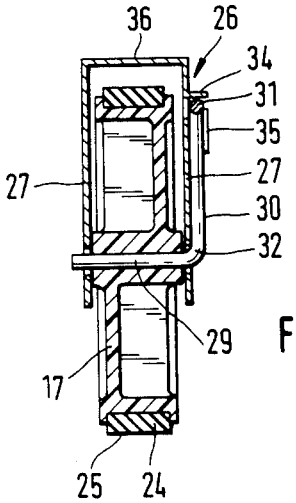
FIG. 8
FIG. 9
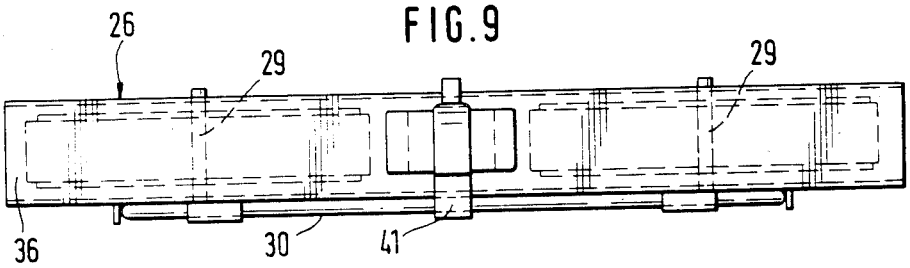

FLOOR-SWEEPING MACHINE

The invention relates to a floor-sweeping machine consisting of a housing with a revolving brush mounted rotatably therein and having pinions which are provided at its two ends and which are themselves each connected operatively by engagement to a pair of running drive wheels, the two running drive wheels belonging to a particular pinion being mounted rotatably in a wheel case and the wheel case being mounted in appropriate housing receptacles so as to be vertically displaceable for adjusting the height of the revolving brush mounted fixedly in the housing.

In this floor-sweeping machine known from German Offenlegungsschrift No. 2,605,832, force accumulators are provided above the two wheel cases, so that, depending on the contact pressure by which the floor-sweeping machine is pressed against the floor to be cleaned, the wheel cases and consequently the running drive wheels are pressed to a greater or lesser extent into the housing. Because of this, an adjustment of the height of the revolving brush mounted fixedly in the housing takes place as a result of the contact pressure. However, since, when the floor-sweeping machine is used as intended, that is to say when the floor-sweeping machine is moved to and fro, the contact pressure cannot be kept constant, the revolving brush cannot be set permanently to a desired height.

The object on which the invention is based is to provide a floor-sweeping machine of the type explained in the introduction, in which such disadvantages are avoided and a permanent adjustment of the height of the revolving brush is possible in a simple way, without impairing the drive of the revolving brush by the running wheels.

This object is achieved, according to the invention, due to the fact that each wheel case is retained by means of a wheel-case holder, so as to swing on one leg of a U-shaped adjusting shackle, and the U-shaped adjusting shackle is mounted pivotably in appropriate bearings of the housing by means of angled portions, shaped on the free ends of the legs, and an adjustable wedge face pivoting the U-shaped adjusting shackle downwards against the effect of a force accumulator engages on the crown part. As a result, the U-shaped adjusting shackle can, in a simple way, be pivoted continuously by means of the adjustable wedge face into any desired position against the effect of the force accumulator, so that a permanent adjustment of the height of the revolving brush is thereby achieved. Since the two wheel cases are retained by means of wheel-case holders so as to swing on the legs of the U-shaped adjusting shackle, the wheel cases and consequently the running drive wheels can adapt themselves to any unevenness of the floor.

The wheel case can consist of sheet metal and have a U-shaped cross-section, the two side legs receiving the running drive wheels between them having perforations for inserting the axle journals carrying the running drive wheels. Thus, by insertion of the axle journals, the two running wheels are retained in a simple way in the wheel case which can be made cheaply.

The axle journals can consist of the angled ends of an approximately U-shaped spring-wire shackle which is retained on the outer side of one of the two side legs of the wheel case. The two axle journals for mounting the two running drive wheels in a wheel case are therefore connected to one another via an approximately U-shaped spring-wire shackle, so that, when the U-shaped spring-wire shackle is attached, both running drive wheels are retained in the wheel case at the same time.

The crown part and the arcs, located between the crown part and the two legs, of the U-shaped wire shackle can rest, on the outside, against stamped-out tongues of the wheel case consisting of sheet metal. As a result, the U-shaped spring-wire shackle is prevented, in a simple way, from being displaced on the side leg of the wheel case.

The two legs of the U-shaped spring-wire shackle can extend at an angle towards one another with their ends having the axle journals, and the clear width of the perforations provided in the side legs of the wheel case exceeds the diameter of the axle journals. As a result, the axle journals are mounted, in a simple way, with substantial play in the perforations of the side legs of the wheel case, so that, when the two running drive wheels are pressed against the floor to be cleaned, the running drive wheels are pressed against the pinion of the revolving brush, located between the two running drive wheels, by the legs of the U-shaped spring-wire shackle which extend at an angle towards one another. By pressing the floor-sweeping machine against the floor to be cleaned, the frictional connection between the running drive wheels and the pinions of the revolving brush is thus increased.

The wheel case having a U-shaped cross-section can have in it crown part, centrally, a perforation for inserting the wheel-case holder consisting of plastic, the wheel-case holder engaging into the perforation by means of two resilient legs having engagement lugs facing away from one another. As a result, the wheel-case holder can be retained on the wheel case in an especially simple way by just being pressed in.

The wheel-case holder can have an arm which is angled to the side and then downwards, and which lays its free end over the U-shaped spring-wire shackle resting against the outer side of the side leg of the wheel case and is supported against the side leg of the wheel case by means of a shaped-on projection. By means of this wheel-case holder, the U-shaped spring-wire shackle can thus be secured in a simple way against being pulled off from the wheel case.

The wheel-case holder can have an approximately C-shaped shackle open to the side, for clamping onto the leg of the U-shaped adjusting shackle. As a result, the wheel case can be connected to the adjusting shackle in a simple way by just being clamped onto the leg of the U-shaped adjusting shackle.

The clear width of the receptacle of the C-shaped shackle can increase towards the ends. As a result, the C-shaped shackle rests only with its central region against the leg of the U-shaped adjusting shackle and can pivot, so that the pivoting movement of the U-shaped adjusting shackle can be converted into a straight vertical movement of the wheel case.

The wheel-case holder can be guided on the side faces of the housing cavity, on the one hand, by means of a pin shaped on the back of the approximately C-shaped shackle and, on the other hand, by means of the back of the shaped-on arm. The wheel case is thereby guided in a simple way for vertical movement in the housing cavity.

Vertically extending ribs for guiding the wheel case can be shaped on the side faces of the housing cavity. Because of this also, the wheel case is guided in a simple way for vertical movement in the housing cavity.

The U-shaped adjusting shackle carrying the wheel cases can extend over the wheel cases approximately parallel to the floor to be cleaned, and attached centrally to the crown part of the adjusting shackle is a peg bent downwards, against which the adjustable wedge face engages. As a result, in a simple way, less room is taken up in the housing for the U-shaped adjusting shackle, adjustment being carried out by means of a peg bent downwards, which is provided on the crown part of the adjusting shackle.

The wedge face interacting with the bent peg of the adjusting shackle can be provided on the free end face of a rotatable tube which is mounted rotatably in the housing and has an actuating handle projecting out from the top side of the housing. Because of this, the wedge face can be adjusted by the operator by simple rotation of the actuating handle and an adjustment of the height of the revolving brush can thus be made.

The force accumulator interacting with the U-shaped adjustment shackle can be formed by an approximately V-shaped leaf spring which engages against the under side of the crown part and is supported by means of its centre part against intermediate walls of the housing and which rests against the crown part of the U-shaped adjusting shackle by means of its two legs. As a result, the adjusting shackle is held frictionally against the adjustable wedge face in a simple and reliable way, so that any set vertical position of the revolving brush is also maintained.

Figure 2:
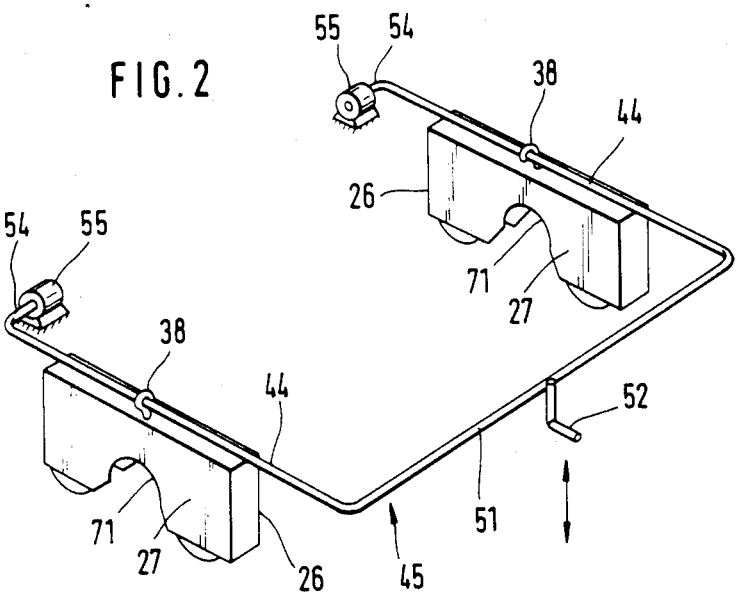
Figure 3:
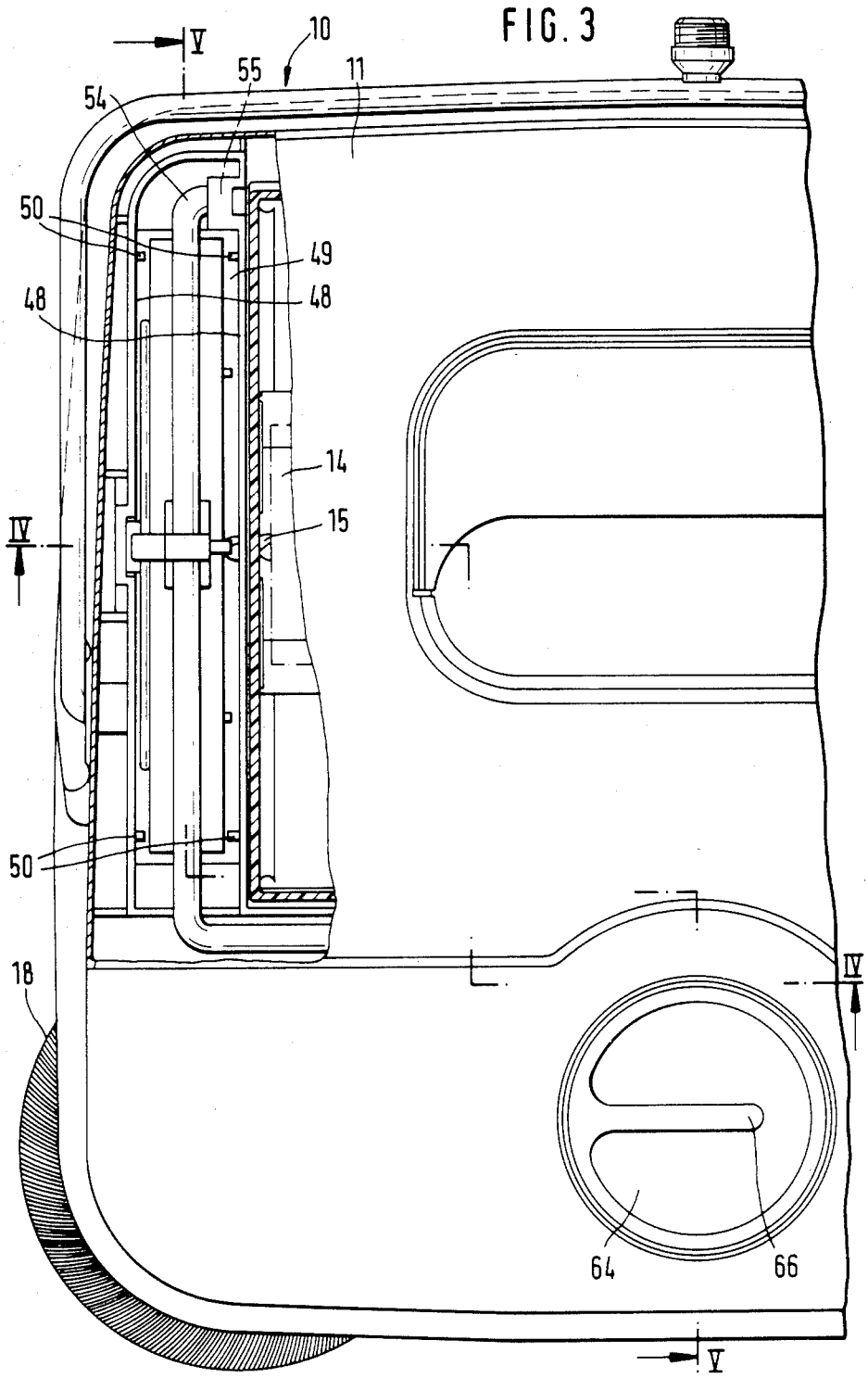
Figure 4:
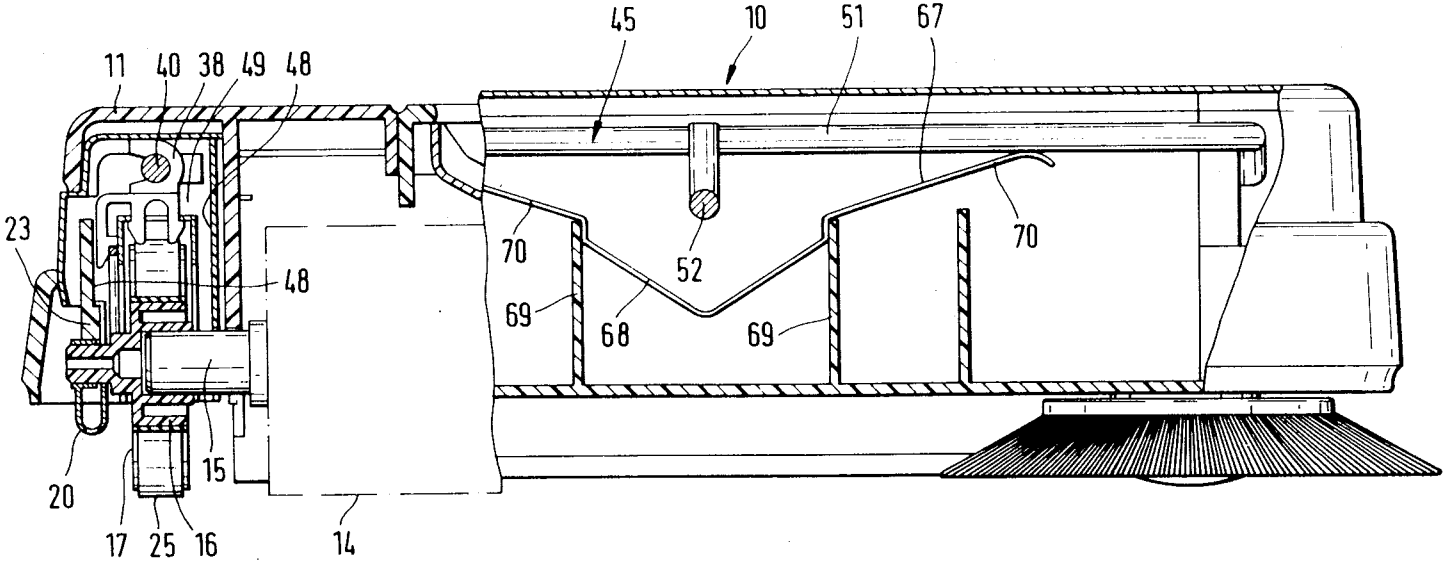
Figure 5:
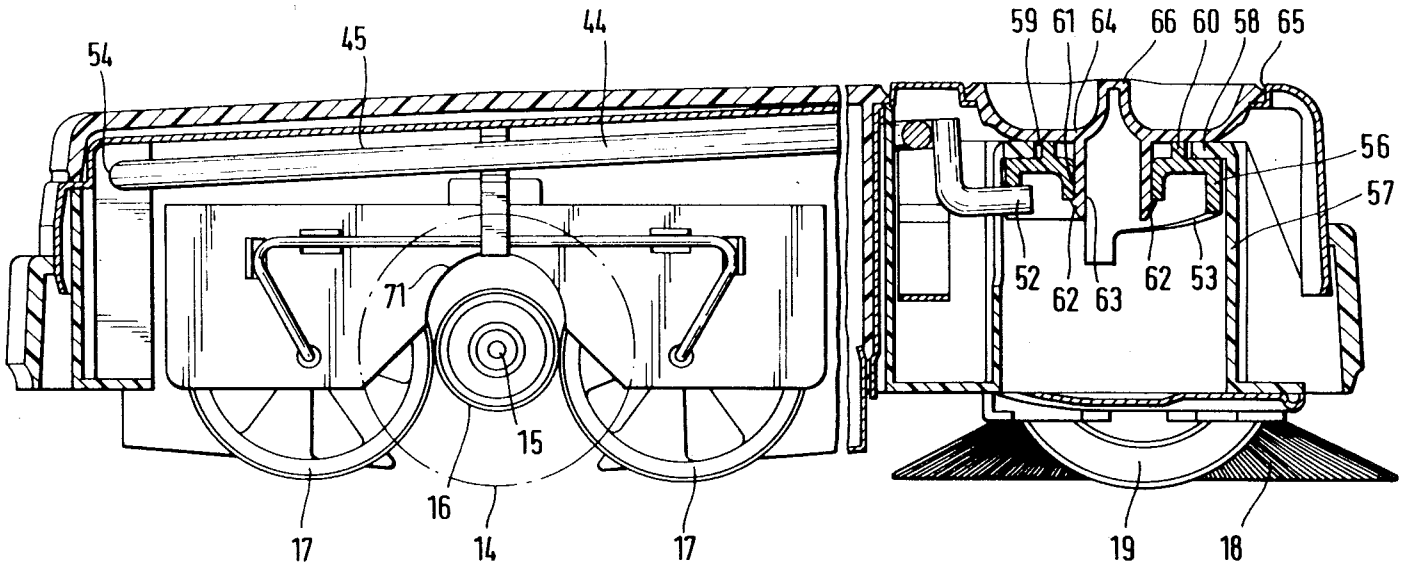

The invention is illustrated in an exemplary embodiment in the drawing in which:

FIG. 1 shows, in a graphical representation, a floor-sweeping machine according to the invention, FIG. 2 shows diagrammatically, in a graphical representation, the device for adjusting the height of the revolving brush, FIG. 3 shows, partially in section, the floor-sweeping machine in a top view, FIG. 4 shows a section along the line IV—IV of FIG. 3, FIG. 5 shows a section along the line V—V of FIG. 3, FIG. 6 shows the wheel case of the floor-sweeping machine in a side view, FIG. 7 shows a section along the line VII—VII of FIG. 6, FIG. 8 shows a section along the line VIII—VIII of FIG. 6 and, FIG. 9 shows the wheel case in a top view.

The floor-sweeping machine 10 illustrated in the drawing consists of a housing 11. The outer side of the housing 11 serves for receiving a stick fork 12 to which is fastened, in turn, a stick-like handle 13 for moving the floor-sweeping machine to and fro over the floor to be cleaned. On the inside of the appliance, the housing 11 serves for receiving sweeping brushes and the running wheels serving for moving the appliance over a floor surface and for driving the sweeping brushes. To pick up the dirt from the floor to be cleaned by the floor-sweeping machine, there is, first of all, a revolving brush 14 which extends transversely to the envisaged direction of movement. To rotate the revolving brush 14 with respect to the floor to be cleaned, pinions 16 are assigned to this at the ends of the axle 15 and are connected operatively to running drive wheels 17 by friction. The running drive wheels 17 are mounted in the housing 11 in pairs in a way still to be explained.

Since the revolving brush 14 can work with a sweeping action only up to a certain distance from the side-wall regions of the floor-sweeping machine 10, additional brushes 18 are provided for covering the side-wall regions, and by means of these the side regions located outside the effective range of the revolving brush 14 can also be covered, as a result of which complete cleaning of the floor even along steps and walls and in corner regions becomes possible.

In the exemplary embodiment illustrated, an additional brush 18 is located in each of the front corner regions of the floor-sweeping machine, in such a way that they are rotatable about a substantially vertical axis and, by means of their bristle rim arranged in the form of a cup, that is to say radially outwards and downwards, overlap the effective range of the revolving brush 14, on the one hand, and the side-wall and front-wall region of the housing 11, on the other hand. For the purpose of rotation effective for sweeping, the two additional brushes 18 are drive-coupled to running drive wheels 19 located between them.

For the rotatable mounting of the revolving brush 14 in the housing 11, there are two bearing clasps 20 which engage respectively on the ends of the revolving brush 14. The bearing clasp 20 is formed by an approximately U-shaped clamp made of spring steel and can be attached frictionally, by means of the two legs of the U-shaped clamp, onto a downwardly directed wall part 23 of the housing 11. By means of these two bearing clasps 20, the revolving brush 14 is retained in the housing 11 so that it can be fitted and removed simply.

As already explained, two running drive wheels 17 are assigned to each of the two pinions 16 of the revolving brush 14. On the running drive wheels 17 arranged in pairs, one running drive wheel 17 is provided in front of the revolving brush 14 and the other running drive wheel 17 is provided behind the revolving brush 14. The running drive wheels 17 have a tread 25 formed by an attached rubber ring 24, and this tread 25 presses against the pinion 16 in a way yet to be described, so that the running drive wheels 17 are drive-coupled to the pinion. When the running drive wheels 17 rotate, rotation of the revolving brush 14 therefore takes place. Since the running drive wheels 17 have a larger diameter than the pinions 16, the revolving brush rotates at a higher speed. The two running drive wheels 17 belonging to a pinion 16 are mounted respectively in wheel cases 26. Such a wheel case is illustrated in more detail in FIGS. 6 to 9.

The wheel case 26 consists of sheet metal and has a U-shaped cross-section, and the two side legs 27 receiving the running drive wheels 17 between them have perforations 28 for inserting the axle journals 29 carrying the running drive wheels 17. Here, the axle journals 29 are formed by the angled ends of an approximately U-shaped spring-wire shackle 30 which is retained on the outer side of one of the two side legs 27 of the wheel case 26. As is evident especially in FIG. 6, the crown part 31 and the arcs 33, located between the crown part 31 and the two legs 32, of the U-shaped spring-wire shackle 30 rest, on the outer side, against stamped-out tongues 34, 35 of the wheel case 26 consisting of sheet metal. The spring-wire shackle 30 can therefore be inserted in a simple way into the wheel case 26 from the side, the axle journals 29 passing through the perforations 28 in the side legs 27 of the wheel case 26, and the running drive wheels 17. Because the spring-wire shackle 30 rests against the tongues 34 and 35, the spring-wire shackle 30 is prevented from being displaced.

As is evident especially in FIG. 6, the two legs 32 of the U-shaped spring-wire shackle 30 extend at an angle towards one another with their ends having the axle journals 29, and the clear width of the perforations 28 provided in the side legs 27 of the wheel case 26 exceeds the diameter of the axle journals 29. By pressing the floor-sweeping machine 10 and consequently the wheel cases 26 having the running drive wheels 17 against the floor to be cleaned, the running drive wheels 17 are consequently pressed in a simple way against the pinion 16 of the revolving brush 14, which is located between them, so that the frictional connection is increased.

It can also be seen from FIGS. 6 to 9 that the wheel case 26 having a U-shaped cross-section has in its crown part 36, centrally, a perforation 37 for inserting a wheel-case holder 38 consisting of plastic. In this case, the wheel-case holder 38 engages into the perforation 37 by means of two resilient legs 40 having engagement lugs 39 facing away from one another. The wheel-case holder 38 can therefore be fastened to the wheel case 26 by simply being inserted into the perforation 37.

The wheel-case holder 38 has an arm 41 which is angled to the side and then downwards, and which lays its free end over the U-shaped spring-wire shackle 30 resting against the outer side of the side leg 27 of the wheel case 26 and is supported against the side leg 27 of the wheel case 26 by means of a shaped-on projection 42. After the wheel-case holder 38 has been inserted into the perforation 37 in the crown part 36 of the wheel case 26, the approximately U-shaped spring-wire shackle 30 is consequently secured, at the same time, against being pulled out laterally.

The wheel-case holder 38 has an approximately O-shaped shackle 43 open to the side for clamping onto the leg 44 of a U-shaped adjusting shackle 45. The adjusting shackle 45 is illustrated in more detail in FIG. 2. FIG. 2 shows diagrammatically the device for adjusting the height of the wheel cases 26 and consequently the running drive wheels 17. Here, the clear width of the receptacle 46 of the C-shaped shackle 43 increases towards the ends. As a result, the wheel case 26 is retained, in a simple way, so as to swing on the leg 44 of the U-shaped adjusting shackle 45, so that, when the adjusting shackle 45 is pivoted, both running drive wheels 17 always rest against the floor to be cleaned. The running drive wheels 17 and consequently the wheel case 26 can therefore also adapt themselves to any unevenness of the floor.

The wheel-case holder 38 is guided on the side faces 48 of a housing cavity 49, provided for receiving the wheel case 26 in the housing 11, on the one hand, by means of a pin 47 shaped on the back of the approximately C-shaped shackle 43 and, on the other hand, by means of the back of the shaped-on arm 41. Moreover, vertically extending ribs 50 for guiding the wheel case 26 are shaped on the side faces 48 of the housing cavity 49.

As a result, the wheel case 26 is guided, in a simple way, so as to be vertically displaceable in the housing cavity 49 of the housing 11.

The U-shaped adjusting shackle 45 carrying the wheel cases 26 extends over the wheel cases 26 approximately parallel to the floor to be cleaned, a peg 52 bent downwards being attached centrally to the crown part 51 of the adjusting shackle 45. An adjustable wedge face 53 engages against the bent peg 52. The adjusting shackle 45 is pivoted by means of this adjustable wedge face 53. The U-shaped adjusting shackle 45 is mounted pivotably in appropriate bearings 55 of the housing 11 by means of angled portions 54 shaped on the free ends of the legs 44.

It is evident from FIG. 5 that the adjustable wedge face 53 engages from above against the bent peg 52. The wedge face 53 interacting with the bent peg 52 of the adjusting shackle 45 is provided on the free end face of a rotatable tube 56 which is mounted rotatably in the housing 11. For the rotatable mounting of the tube 56, there is in the housing 11 a receptacle 57 opening downwards, into which the rotatable tube 56 is inserted. The bottom 58 of the receptacle 57 has a perforation 59 into which engages a tubular extension 60 of the rotatable tube 56. The rotatable tube 56 has a central perforation 61 into which engages an extension, having engagement lugs 62, of an actuating handle 64. During assembly, therefore, the rotatable tube 56 must be inserted into the receptacle 57 from below and then pressed onto the actuating handle 64 from above. The actuating handle 64 is located in an orifice 65 in the top side of the floor-sweeping machine, so that the operator can rotate the actuating handle by grasping the rib 66. Rotation of the actuating handle 64 results, at the same time, in rotation of the rotatable tube 56 together with the wedge face 53 which is provided on it and which presses onto the bent peg 52 of the adjusting shackle 45. An adjustment of the adjusting shackle 45 and consequently an adjustment of the height of the running drive wheels 17 thereby take place. As a result of the adjustment in the height of the wheel cases 26 and consequently the running drive wheels 17, an adjustment of the height of the revolving brush 14, which is mounted fixedly in the housing 11 of the floor-sweeping machine 10, is achieved.

The U-shaped adjusting shackle 45 pivots against the effect of a force accumulator 67. As is evident especially in FIG. 4, the force accumulator is formed by an approximately V-shaped leaf spring which engages against the underside of the crown part 51 of the adjusting shackle 45 and which is supported by means of its centre part 68 against intermediate walls 69 of the housing 11. The two legs 70 of the approximately V-shaped leaf spring 67 rest against the under side of the crown part 51 of the U-shaped adjusting shackle 45. By means of this U-shaped leaf spring 67, the bent peg 52 of the adjusting shackle 45 is therefore held frictionally against the wedge face 53 of the actuating handle 64, so that any set position of the actuating handle 64 is also maintained by the wheel cases 26 and consequently also by the running drive wheels 17.

During assembly of the floor-sweeping machine 10, the wheel cases 26 together with the running drive wheels 17 are first inserted into the housing 11 and connected to the adjusting shackle 45. Subsequently, the revolving brush 14 is fastened in the housing 11 by means of the bearing clasps 20. The side legs 27 of the wheel cases 26 have, in the centre, cut-out portions 71 open downwards for inserting the revolving brush 14 and the pinions 16 between the running drive wheels 17.

As already mentioned, the design illustrated is only one example of putting the invention into practice and the latter is not restricted to this. Instead, many other designs and modifications are possible.

We claim:

1. In a floor-sweeping machine of the type including a housing having a top portion, a cylindrical brush rotatably mounted in the housing and drive wheels engaging the brush for rotation thereof, the combination comprising:

adjusting means pivotally mounted in the housing for varying the height of the housing relative to the wheels, said adjusting means having two legs;

a casing rotatably supporting at least some of the wheels;

means for clamping said casing to one of said legs of said adjusting means, said clamping means having oppositely directed projections for guiding the movement of the casing in the housing;

means for urging said adjusting means in a direction towards the top portion of the housing; and wedge means engaging said adjusting means for moving said adjusting means oppositely to said direction.

2. The floor-sweeping machine according to claim 1 wherein said casing has a U-shaped cross section, oppositely located side walls between which the wheels are mounted, each of said side walls bounding a first and a second opening, and an axle positioned in each of said first and second openings and supporting the wheels for rotation thereabout.

3. The floor-sweeping machine according to claim 1, wherein said casing further includes a U-shaped resilient wire shackle having leg portions and being positioned on one of said side walls, said leg portions having angled projections each of which forms at least a portion of said axle.

4. The floor-sweeping machine according to claim 3 wherein each one side wall has tongue portions for mounting said resilient wire shackle.

5. The floor-sweeping machine according to claim 3 wherein said leg portions extend at an angle towards one another and wherein the width of said first and said second opening exceeds the diameter of said axle.

6. The floor-sweeping machine according to claim 2, wherein said casing has a portion which bounds a third opening and wherein said clamping means has two resilient legs, said legs having oppositely directed engagement lugs for insertion into said third opening.

7. The floor-sweeping machine according to claim 6 wherein said clamping means further includes an arm which is positioned on said U-shaped resilient wire for holding said wire on said one side wall.

8. The floor-sweeping machine according to claim 1 wherein said clamping means has a C-shaped section in which said leg of said adjusting means is positioned, the width of the C-shaped section increasing towards the ends thereof.

9. The floor-sweeping machine according to claim 1 wherein the housing has ribs extending from the interior surface thereof for guiding the movement of the casing.

10. The floor-sweeping machine according to claim 1 wherein said adjusting means further includes a peg against which said wedge means engages.

11. The floor-sweeping machine according to claim 1 wherein said wedge means further includes an actuating handle for movement of said wedge means.

12. The floor-sweeping machine according to claim 1 wherein said urging means includes a substantially V-shaped leaf spring, and wherein the housing further includes interior wall sections, said spring being held in position by said wall sections.

13. A floor-sweeping machine comprising:

a housing;

cylindrical brush means rotatably mounted in said housing at a predetermined location therein;

at least one casing mounted on said housing for movement in a direction substantially normal to the plane of the surface to be cleaned as considered in the position of use;

engaging means rotatably mounted on said casing and operative for contacting the surface to be cleaned to support the housing thereon and for rotating said brush means;

means for adjusting the distance in said direction between said casing and at least a portion of said housing and means for maintaining said adjusted distance.

* * * * *